United States Patent [19]

Taylor

[11] Patent Number: 4,878,331

[45] Date of Patent: Nov. 7, 1989

[54] METAL ROOFING STRUCTURE

[75] Inventor: Duane F. Taylor, Salem, Oreg.

[73] Assignee: Janet R. Taylor, Salem, Oreg.

[21] Appl. No.: 79,242

[22] Filed: Jul. 28, 1987

[51] Int. Cl.[4] ..... E04D 3/362; E04D 3/363

[52] U.S. Cl. ..... 52/519; 52/531

[58] Field of Search ..... 52/478, 521, 520, 536, 52/537, 519, 531

[56] References Cited

U.S. PATENT DOCUMENTS

| | | | |
|---|---|---|---|
| 476,381 | 6/1892 | Hawthorne . | |
| 2,148,434 | 2/1939 | Calkins | 52/531 |
| 2,873,699 | 2/1959 | Cookson . | |
| 3,041,784 | 7/1962 | Facer | 52/521 |
| 3,135,070 | 6/1964 | Waring | 52/478 |
| 3,473,274 | 10/1969 | Godes | 52/543 |
| 3,495,363 | 2/1970 | Johnson | 52/60 |
| 3,552,078 | 1/1971 | Mattes | 52/531 |
| 3,606,720 | 9/1971 | Cookson . | |
| 3,667,185 | 6/1972 | Maurer | 52/478 |
| 4,271,653 | 6/1981 | Buchhorn | 52/520 |
| 4,400,922 | 8/1983 | Boyer . | |
| 4,495,743 | 1/1985 | Ellison | 52/520 |
| 4,602,469 | 7/1986 | Nuckel | 52/536 |

FOREIGN PATENT DOCUMENTS

| | | | |
|---|---|---|---|
| 255260 | 11/1964 | Australia | 52/520 |

OTHER PUBLICATIONS

U.S. West Direct, Yellow Pages for Oregon, p. 480 (Salem, 1987).

*Primary Examiner*—John E. Murtagh

*Attorney, Agent, or Firm*—Klarquist, Sparkman, Campbell, Leigh & Whinston

[57] ABSTRACT

A roofing structure includes a series of overlapping, interlocking panels, each of which has a small ridge and a large ridge at opposing edges of the panel. The large ridge of each panel overlaps a small ridge on an adjoining panel, but the ridges are sized and spaced from one another to interrupt capillary movement of water between them. Each panel is fastened to a roof board using a noninvasive fastener which fits within a groove in the upper surface of each panel. The fastener can slide relative to the groove to allow expansion and contraction of the panel without buckling or breaking.

9 Claims, 1 Drawing Sheet

METAL ROOFING STRUCTURE

BACKGROUND OF THE INVENTION

1. Field of the Invention

This invention relates to interlocking roofing panels, and more particularly to metal roofing panels.

2. General Discussion of the Background

It has long been known that the roof of a structure can be protected by roofing materials such as asphalt, slate, or metal. U.S. Pat. No. 2,873,699, for example, shows a metal roof which includes a series of side-by-side roofing panels which have interlocking edges that slide one into the other. Each panel is held to a roof board by inserting a nail through the panel into the board. The adjoining interlocking panel covers the nail head to protect it and inhibit moisture from seeping through the nail hole to the roof board. Such an arrangement does not completely prevent seepage of water through the nail hole and into the roof board because the interlocking ridges of the panels fit snugly, one within the other, and capillary action allows water to move between them to the region of the nail head.

U.S. Pat. No. 3,495,363 attempted to overcome the problem presented by capillary movement of water between interlocking ridges of adjoining panels. The outer interlocking ridge was made much larger than the inner ridge such that the inner ridge formed a dam between the nail head and the edge of the larger ridge which was exposed to environmental moisutre. The inner and outer ridges, however, were still close enough together that capillary action permitted movement of water between the ridges, over the dam, and to the nail head, whence water moved through the panel into the roof board.

U.S. Pat. Nos. 3,606,720 and 4,400,922 both show interlocking roofing panels. Neither of the foregoing interlocking roofing panels can adequately interrupt capillary flow of water between the interlocking ridges of the panels to prevent seepage of moisture through the nail holes of the panels to the underlying roof board.

Yet another drawback with roofing systems such as those shown in U.S. Pat. Nos. 3,495,363 and 3,606,720 is that each panel is secured to an underlying structure with a nail or screw which pierces the panel and fixes it rigidly to the structure. The hole produced by piercing the panel provides a site through which moisture can pass to the underlying structure. Moreover, the rigid attachment site does not accommodate normal expansion and contraction of the panel in response to changing environmental temperatures. The panel therefore buckles and cracks.

It is accordingly a primary object of this invention to provide a roofing structure which prevents moisture on a roof from entering joints and seeping beneath roofing panels.

It is another primary object of this invention to provide a roofing structure which can expand and contract in response to changing environmental temperatures without buckling or popping.

It is yet another primary object of the invention to provide such a roofing structure which is easy and convenient to install.

SUMMARY OF THE INVENTION

The foregoing objects are achieved by a roofing panel made of a sheet of material having an upper surface, a lower surface, and small and large ridges which project upwardly from the upper surface and define channels thereunder. Each small ridge has an ascending wall, a descending wall, and a top wall between them. The small ridge is sized to be received within a large ridge of an overlapping sheet with the top wall of the small ridge spaced a sufficient distance from the large ridge to allow ventilation and interrupt capillary movement of water between the small and large ridges. In preferred embodiments of the roofing panel, the descending wall of the small ridge is also spaced a sufficient distance from the large ridge to interrupt capillary movement of water between the small and large ridges.

A groove in the upper surface of the panel receives a fastening means which is inserted in the groove without piercing the panel. The fastening means is preferably a lipped slip plate having a screw fastener which anchors the slip plate in the roof board beside the panel. When the roofing panel is secured with the screw-anchored slip plate lip in the groove, the roofing panel can expand and contract in the direction of the groove without buckling or bending.

The small and large ridges are also provided with locking means for selectively interlocking the small and large ridges. The locking means includes a horizontal channel in the small ridge into which fits a locking flange of the larger ridge.

The foregoing and other objects, features, and advantages of the invention will become more apparent from the following detailed description of a preferred embodiment which proceeds with reference to the accompanying drawings.

DETAILED DESCRIPTION OF A PREFERRED EMBODIMENT

Figure 2:
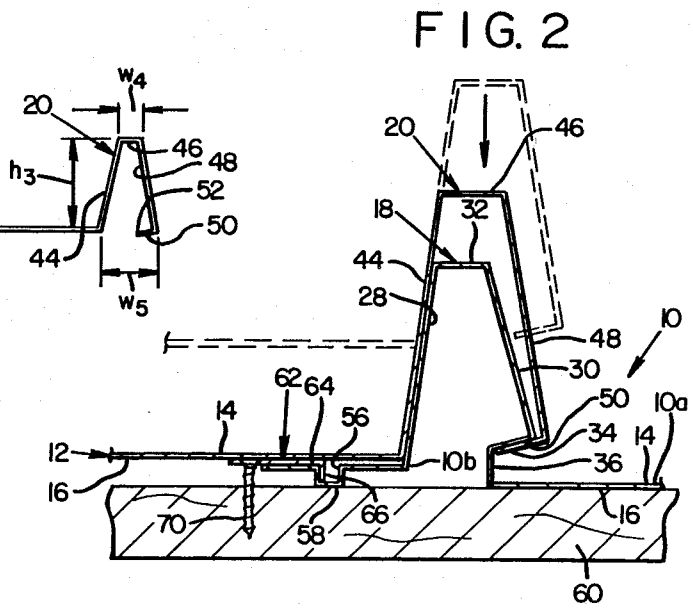
FIG. 2 is a fragmentary, elevational sectional view of the interlocking ridges of a pair of adjoining panels, the position of the large ridge before it is snapped down over the small ridge being shown in phantom, the fastener plate for holding the bottom panel to the roof board also being shown in place.

The roofing system of the present invention is shown in the drawings. The system includes an assembly of overlapping, interlocking metal panels 10, each being made of a rectangular sheet having an upper surface 14 and a lower surface 16. A small ridge 18 projects upwardly from upper surface 14 along a first longitudinal edge 19 of sheet 12, and a large ridge 20 projects upwardly from upper surface 14 along an opposing longitudinal edge of sheet 12. Ridges 18, 20 are parallel to one another and each forms an underlying, downwardly-opening channel. A plurality of corrugations 22, which extend parallel to ridges 18, 20 longitudinally across sheet 12, provide additional structural strength and some lateral flexibility for panel 10.

Panel 10 is generally made of 22 to 28 gauge metal. The panel is divided by small ridge 18 into a primary panel portion 10*a* which extends between ridges 18, 20, and a secondary or attachment panel portion 10*b* which extends between small ridge 18 and edge 19. Portion 10*b* may be higher than panel 10*a* by a distance $h_1$ (FIG. 3) to accommodate a channel described subsequently.

Each small ridge 18 has an ascending wall 28 which inclines about ten degrees from vertical, a descending wall 30 which inclines about fifteen degrees from vertical, and a top flat wall 32 between the ascending and descending wall. Small ridge 18 further includes an inwardly directed wall 34 (FIG. 2) which extends inwardly at about a ninety degree angle from descending wall 30, and a downwardly extending vertical wall 36 depending from inwardly directed wall 34. The inwardly directed wall 34 and downwardly extending wall 36 of small ridge 18 form, in cooperation with upper surface 14 of sheet 12, a horizontally-opening channel 38 along one side of small ridge 18.

Each large ridge 20 has an ascending wall 44 inclined at substantially the same angle as ascending wall 28 of small ridge 18 such that, when two panels are engaged, the ascending wall of the large ridge rests on the ascending wall of the small ridge. Each large ridge 20 also has a top flat wall 46 spaced a sufficient distance, preferably ¼ inch, from the top wall 32 of small ridge 18 to allow air flow and interrupt capillary movement of water between the small and large ridges when they are interlocked. Large ridge 20 is also wider than small ridge 18 and includes a descending wall 48 which, in use, inclines at about ten degrees from the vertical, which is a greater slope than the slope of descending wall 30 of small ridge 18 such that the descending walls of the small and large ridges are spaced apart a sufficient distance to interrupt capillary movement of water between the descending walls and allow air flow. In the disclosed embodiment, walls 30, 48 are spaced at least 1/16 inch apart at the area of least separation between them. An inwardly directed hook flange 50 extends from descending wall 48 at about a right angle and fits within horizontal channel 38 when small ridge 18 is in place within large ridge 20. The illustrated flange is sufficiently long that its distal edge 52 engages the wall 36. The flange 50 thus acts as a spacer to maintain the walls 30 and 48 a sufficient distance apart to prevent water from being carried to the top of the small ridge 18 by capillary action.

A groove 56 in upper surface 14 extends parallel to small ridge 18 between edge 19 and ascending wall 28. Groove 56 has a rectangular cross section and projects downwardly from sheet 12 a distance h (FIG. 3) equal to the difference in height of panels 10*a*, 10*b*. A bottom wall 58 of groove 56 therefore rests on roof board 60 and is level with sheet 10*a* on the opposite side of ridge 18.

Each panel 10 is held flat against roof board 60 by a slip plate 52 which permits each panel 12 to expand and contract longitudinally without buckling or breaking the fastener or panel. Slip plate 62 includes a plate number 64 which is wide enough to extend from groove 56 past edge 19. A lip 66 extends downwardly from plate member 64 for insertion in groove 56. A hole 68 is provided through plate member 64 and spaced a sufficient distance from lip 66 that a screw 70 can be placed through plate 62 and into roof board 60 without penetrating panel 10.

Dimensions

Figure 3:
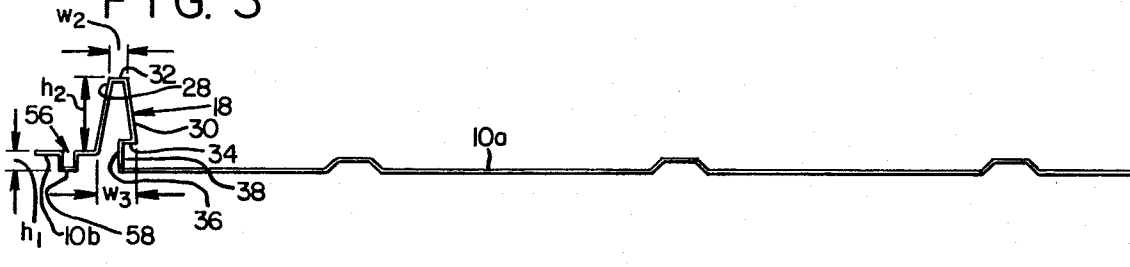
FIG. 3 is a schematic elevational view of one of the panels.

Without limiting the invention to any specific dimensions, the following example will illustrate one way to make the roofing panel of the present invention. As shown in FIG. 3, small ridge 18 has a height $h_2$ from panel 10*b* to top wall 32 of ¾ inch, a width $w_2$ across top wall 32 of ⅛ inch, and a width $w_3$ of ½ inch across the bottom of ridge 18, beginning at panel 10*b* and extending to the farthest point of wall 30.

Ascending wall 44 of large ridge 20 has a vertical height $h_3$ of one inch, a top width $w_4$ of 3/16 inch across top wall 46, and a width $w_5$ of ⅝ inch from the beginning of ridge 20 at panel 10*a* to the foremost tip of wall 48 where flange 50 joins wall 48.

These dimensions permit ridge 20 to be interlocked over ridge 18 with sufficient spacing between the ridges to allow adeuate ventilation and interrupt capillary flow of liquid between them. The ¼ inch wall spacing and diverging walls interrupt capillary movement of water between the walls from the exterior of the panels. The flange 50 is dimensioned so that the separation between descending walls 30, 48 is about 1/16 inch at the region of least separation, i.e., where flange 50 extends into channel 38. Ascending wall 44 of an adjoining panel rests against wall 28, which automatically spaces panels and prevents creeping.

Method of Use

Figure 1:
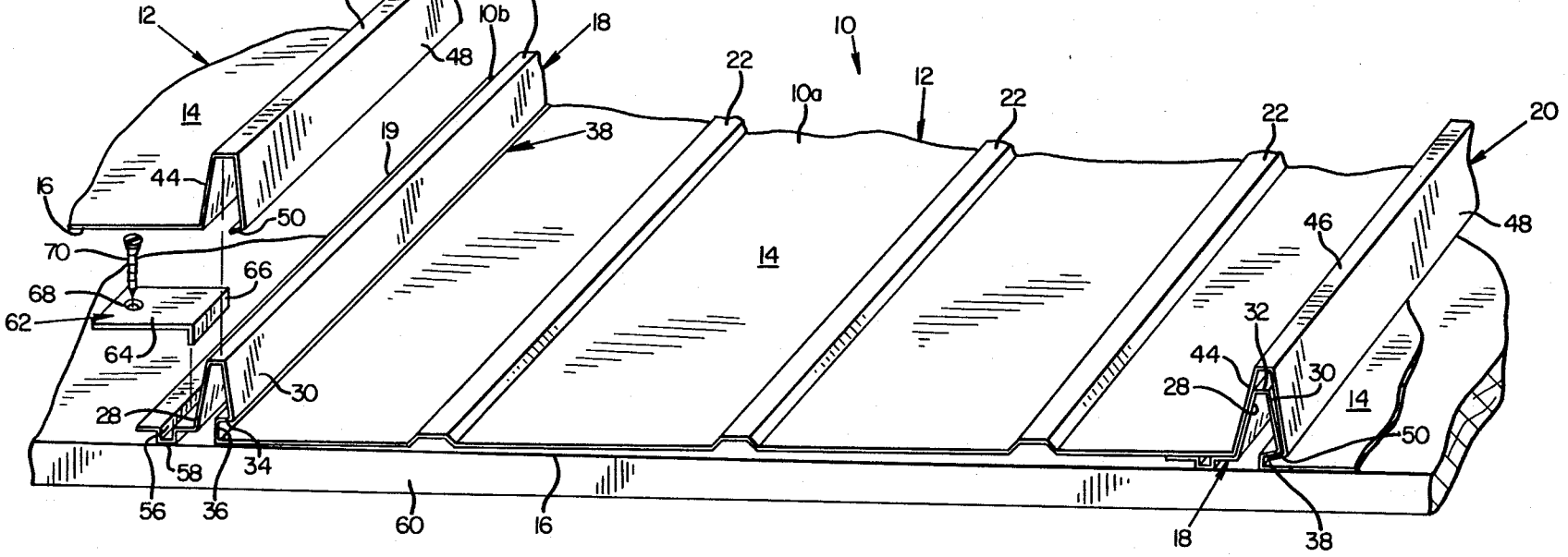
FIG. 1 is a fragmentary, perspective view of an interlocking panel of the present invention coupled at its opposite edges to adjoining panels.

In use, a panel 10 is positioned on roof board 60 with a transverse edge of the panel aligned with an edge of the roof board as shown in FIG. 1. Plate 62 is then positioned as shown in FIG. 2 with lip 66 extending downwardly into groove 58 and hole 68 positioned beyond edge 19 and over roof board 60. Screw 70 is then inserted through hole 68 into roof board 60 to secure plate 62 tightly against roof board 60 without piercing panel 10. More than one plate 62 may be used to secure panel 10, while still permitting panel 10 to slide relative to plate 62. Panel 10 is therefore free to expand and contract in the direction of groove 58 without breaking plate 62 or damaging panel 10.

Large ridge 20 of an adjoining panel is then positioned over small ridge 18, as shown in phantom in FIG. 2. Ridge 20 is then moved down in the direction of the arrow in FIG. 2 until small ridge 18 is inserted into the open bottom of ridge 10, and hook flange 50 moves into channel 38. Slip plates 62 are used to secure the adjoining panel, and the process is repeated over the entire surface of the roof.

Having illustrated and described the principles of the invention in a preferred embodiment, it should be apparent to those skilled in the art that the invention can be modified in arrangement and detail without departing from such principles. I claim all modifications within the spirit and scope of the following claims.

I claim:

1. In a roofing panel interlockingly joinable with longitudinally adjacent panels of substantially identical type, each panel being a rigid sheet having an upper surface, a lower surface, first and second parallel longitudinal edges, a substantially planar primary panel portion between the edges, a large ridge which extends parallel to and between the first longitudinal edge and the primary panel portion and projects upwardly from the sheet, the ridge including an inclined ascending wall nearest the first longitudinal edge, a top wall substantially parallel to the primary panel portion, and an inclined descending wall, the large ridge defining a downwardly opening channel, and a small ridge which extends along and between the second longitudinal edge and the primary panel portion, projects upwardly from the sheet, and includes an inclined ascending wall nearest the second longitudinal edge, a top wall substantially parallel to the primary panel portion, and an inclined descending wall, the improvement wherein:

the small ridge is sized and configured to be received, without significant play and in a substantially self-aligning manner, within the channel defined by the large ridge of a longitudinally overlapping sheet;

the inclined ascending wall of the small ridge inclines at substantially the same angle as the inclined descending wall of the large ridge;

after installation, the top wall of the small ridge is sufficiently spaced below the top wall of an overlapping large ridge of a longitudinally adjacent panel to provide ventilation and to interrupt movement of water therebetween;

the upper surface of the inclined descending wall of the small ridge defines a horizontally opening channel which opens toward the primary panel portion;

the large ridge has a hook flange that extends, from the bottom of the ascending wall of the large ridge, generally horizontally into the channel defined by the large ridge;

the hook flange and horizontally opening channel are positioned, for the purpose of interlockingly joining a longitudinally adjacent panel, so that when the panels are joined the hook flange fits within the horizontally opening channel of the small ridge of the adjacent panel when the small ridge of the adjacent panel is received within the channel defined by the large ridge of the overlapping first panel and so that the hook flange is elevated above the upper surface of the adjacent panel;

the hook flange engages a portion of the wall which defines the horizontally opening channel of the adjacent panel while the inclined descending wall of the large ridge abuts the inclined ascending wall of the small ridge of the adjacent panel so that the joint between adjacent panels is formed only by interengagement of the panels, without separate fastening devices;

the hook flange and top walls are of sufficient lengths that, when the channel defined by the large ridge receives the small ridge of an adjacent longitudinally underlapping panel, the inclined ascending wall of the large ridge and the inclined descending wall of the small ridge are at least partially spaced apart so as to interrupt upward capillary movement of water and allow ventilation therebetween;

the inclined descending wall of the small ridge extends between the top wall of the small ridge and the horizontally opening channel in such a manner that the upper surface of that descending wall acts as a camming surface to guide the hook flange of an adjacent panel toward the horizontally opening channel during installation; and an attachment panel portion extends horizontally outwardly between the bottom of the ascending wall of the small ridge and along and between that ascending wall and the second longitudinal edge, the attachment panel portion being the only means by which the panel is attached to underlying roof support boards, attachment being accomplished by fasteners which engage the attachment panel portion and thus are positioned to be concealed when the small ridge is received in the channel defined by the large ridge of an adjacent panel.

2. The improvement of claim 1 wherein each panel further comprises an upwardly opening channel, in the attachment panel portion, for receiving a fastening means which is inserted in the upwardly opening channel without piercing either the panel or any adjoining panel, the fastening means being substantially concealed beneath a second such panel that has been interlockingly joined longitudinally with the first panel by lapping the channel defined by the large ridge of the second panel over the small ridge of the first panel.

3. A roofing panel interlockingly joinable with longitudinally adjacent panels of substantially identical type, each panel comprising:

a rigid sheet having opposing parallel longitudinal edges, an upper surface, a lower surface, and small and large ridges projecting upwardly from the upper surface, a small ridge adjacent and parallel to one longitudinal edge, and a large ridge extending along and including the opposing longitudinal edge;

the small ridge having an inclined ascending wall adjacent the respective longitudinal edge, an inclined descending wall, a top flat wall between the ascending and descending walls, an inwardly directing wall which extends inwardly from the inclined descending wall, and a downwardly extending wall extending from the inwardly directed wall, the inwardly directed and downwardly extending wall of the ridge forming, in cooperation with the upper surface of the sheet, a horizontally opening channel in the small ridge;

the large ridge having an ascending wall nearest the respective longitudinal edge and inclined at substantially the same angle as the inclined descending wall of the small ridge, a top flat wall higher than the top flat wall of the small ridge to interrupt movement of water between the respective small and large ridges of longitudinally interlocked panels, an inclined ascending wall which inclines at a greater slope than the inclined descending wall of the small ridge, and an inwardly directed hook flange to be received simultaneously against the inwardly directed and downwardly extending walls of the horizontally opening channel in the small ridge of a longitudinally adjacent interlocked panel when the small ridge of the adjacent panel is nested within the channel defined by the large ridge; and an upwardly opening channel extending parallel to the small ridge in the upper surface of the panel between the inclined ascending wall of the small ridge and the nearest longitudinal edge.

4. In a roof panel assembly having a plurality of substantially identical sheets each having upper and lower surfaces and first and second parallel longitudinal edges, the first longitudinal edge of each sheet overlapping the second longitudinal edge of the adjacent sheet in an interlocking manner, the improvement wherein:

where sheets overlap, the lower surface of the overlapping sheet defining a downwardly opening channel extending along and including the first longitudinal edge, and the underlying sheet having a ridge projecting upwardly from its upward surface parallel to the second longitudinal edge of the underlying sheet, the ridge nesting within the channel without significant play and in a substantially self-aligning manner;

the ridge includes an inclined ascending wall nearest the second longitudinal edge of the underlying sheet, a top wall substantially parallel to the sheet, and an inclined descending wall;

the downwardly opening channel includes an inclined ascending wall nearest the first longitudinal edge of the overlapping sheet, a top wall substantially parallel to the sheet, and an inclined descending wall;

the inclined descending wall of the downwardly opening channel inclines at substantially the same angle as the inclined ascending wall of the ridge and resting on the ascending wall of the ridge;

the inclined ascending wall of the channel has a greater slope than the inclined descending wall of the ridge such that, when the ridge is nested within the channel, the inclined descending wall of the ridge and the inclined ascending wall of the channel become progressively more spaced apart from the bottom upwardly, thereby allowing ventilation and interrupting movement of water between the ridge and channel;

the top wall of the ridge is spaced below the top wall of the channel sufficiently for ventilation and to prevent movement of water therebetween;

the inclined descending wall of the ridge defines a horizontally opening channel;

the edge of the inclined ascending wall of the channel is formed into an inwardly directed continuous hook flange fitting within the horizontally opening channel of the ridge when the ridge is received within an overlapping channel, such that the hook flange is kept elevated above the surface of the adjacent sheet.

5. The improvement of claim 4 further comprising attachment means for fastening the panels to a substrate without requiring perforations in any panel, the attachment means allowing each fastened panel to slide relative to one another and relative to the attachment means during expansion and contraction of the panel.

6. The improvement of claim 5 further comprising an upwardly opening channel defined in the upper surface of each panel.

7. The improvement of claim 6 further comprising a plurality of fasteners each comprised of a plate attachable to the substrate and having a lip means that fits in the channel, thereby allowing the channel to move relative to the lip means of the fastener during expansion and contraction of the panel.

8. The improvement of claim 7 wherein the upwardly opening channel extends adjacent and parallel to the inclined ascending wall of the ridge, between the inclined ascending wall of the ridge and the adjacent longitudinal edge of the sheet.

9. The improvement of claim 4 wherein the hook flange on the overlapping sheet fits within the horizontally opening channel on the underlying sheet and is sufficiently wide to hold the inclined ascending wall of the channel a distance away from the inclined descending wall of the ridge.

* * * * *